US005379581A

United States Patent [19]

Tobler

[11] Patent Number: 5,379,581

[45] Date of Patent: Jan. 10, 1995

[54] APPARATUS FOR REVERSE-THREADING A CENTRAL YARN-SPINNING PASSAGE

[76] Inventor: Martin Tobler, Hinwilerstrasse 58, CH-8623 Wetzikon, Switzerland

[21] Appl. No.: 817,456

[22] Filed: Jan. 6, 1992

[30] Foreign Application Priority Data

Jan. 4, 1991 [CH] Switzerland ..... 00016/91-7

[51] Int. Cl.[6] ..... D01H 13/26; D01H 9/00

[52] U.S. Cl. ..... 57/280; 57/261

[58] Field of Search ..... 57/261, 263, 279, 280

[56] References Cited

U.S. PATENT DOCUMENTS

| | | | |
|---|---|---|---|
| 3,962,855 | 6/1976 | Stahlecker | 57/263 |
| 4,114,356 | 9/1978 | Eckhardt | 57/263 |
| 4,489,544 | 12/1984 | Morita et al. | 52/261 |
| 4,545,193 | 10/1985 | Tanaka et al. | 57/263 X |
| 4,565,062 | 1/1986 | Nickolay | 57/261 X |
| 4,570,430 | 2/1986 | Stahlecker | 57/260 |
| 4,653,260 | 3/1987 | Artzt et al. | 57/263 |
| 4,893,461 | 1/1990 | Artzt et al. | 57/280 X |
| 4,939,895 | 7/1990 | Raasch et al. | 57/263 |

FOREIGN PATENT DOCUMENTS

| | | |
|---|---|---|
| 0433832 | 10/1990 | European Pat. Off. . |
| 3336294 | of 1984 | Germany . |
| 3413894 | of 1984 | Germany . |
| 3744758 | of 1988 | Germany . |
| 62-4666 | of 1987 | Japan . |

*Primary Examiner*—Daniel P. Stodola
*Assistant Examiner*—William Stryjewski

[57] ABSTRACT

Apparatus for reverse threading a yarn through a yarn-spinning device having a central yarn passage having an outlet end and a longitudinal axis, the apparatus comprising a nozzle for receiving a thread end, aligning with the yarn passage, and reversely blowing the thread end through the yarn passage, the nozzle including a longitudinal recess having an open end for receiving the thread end and a longitudinal cylindrical aperture communicating With the recess, the thread end being receivable through the open end of the recess into the cylindrical aperture, the cylindrical aperture having an axis, the apparatus further comprising a mechanism for moving the nozzle from a first yarn-receiving position to a second yarn-delivering position at the outlet end of the central yarn passage, the axis of the cylindrical aperture being aligned with the axis of the yarn passage when the nozzle is in the second position, the nozzle further comprising an air conduit connected at one end to a source of pressurized air and discharging at another end into the recess such that air is blown through the recess and reversely through the central yarn passage when the nozzle is in the second position.

25 Claims, 2 Drawing Sheets

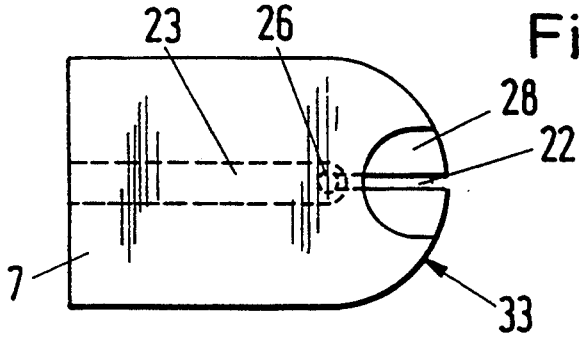
Fig. 3a
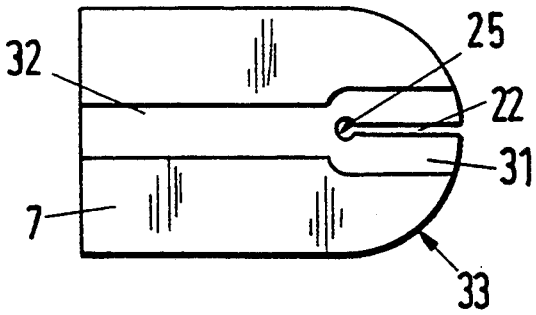
Fig. 3b
Fig. 3d
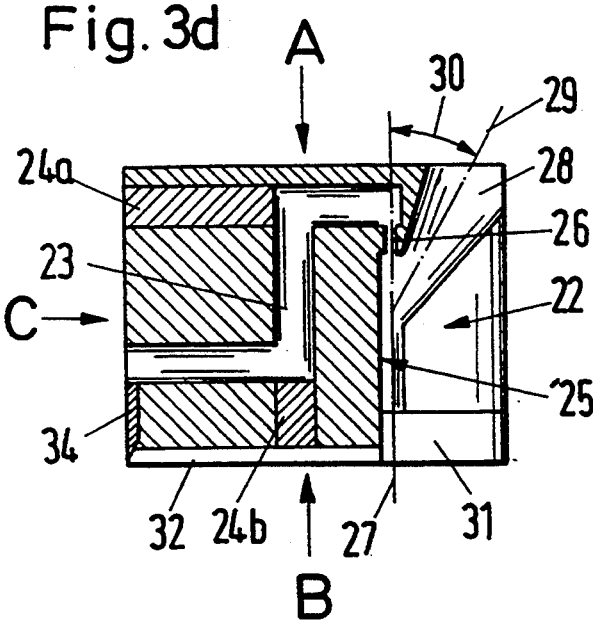
Fig. 3c
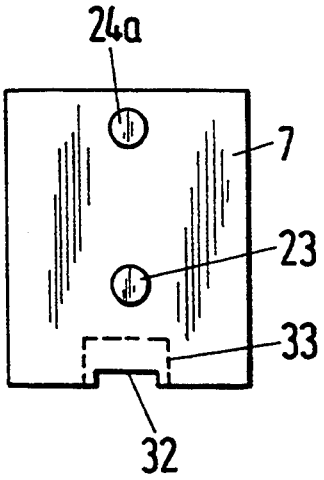
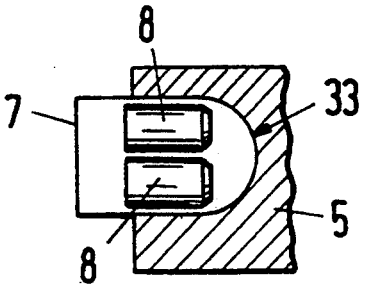
Fig. 4

APPARATUS FOR REVERSE-THREADING A CENTRAL YARN-SPINNING PASSAGE

BACKGROUND OF THE INVENTION

The present invention relates to an apparatus for receiving an end of a thread and reverse threading the thread end through a yarn spinning passage.

A yarn end receiving and positioning apparatus having a reverse air-blowing nozzle and a pair of transport rollers is known from a Japanese utility patent 62-46666. The air nozzle has a guide region and a thread guide with an air-blowing element which is mounted to move to and fro on the guide region. This thread guide is open on one side and forms a closed conduit in a longitudinal direction relative to the guide region. The air-blowing element leads over a conduit at an angle of about 45° in the longitudinal conduit of the nozzle. The above-described air-blowing nozzle is limited in that the suction effect is too small to guide the end of the thread reliably through a longitudinal yarn spinning passage of small diameter.

SUMMARY OF THE INVENTION

It is an object of the invention to provide an apparatus for receiving a thread end having an effective suction effect on the end of a thread to be received and at the same time enable the end of the thread to be reliably guided through a long and narrow air jet spinning nozzle yarn passage, even when the spinning nozzle comprises physically separate components, such as an injector nozzle and a twist nozzle.

It is a further object of the invention to provide a housing component disposed above the outlet end of the spinning nozzle which is selectively contoured for positioning and aligning a reverse-threading apparatus at the outlet end of a yarn spinning passage.

The apparatus of the invention enables a thread-guiding air current to be blown axially along the yarn passage of a yarn-spinning nozzle. The apparatus further enables a more effective suction effect to be exerted on the end of the thread such that the end of a thread to be reversely routed through the yarn spinning passage may be reliably drawn into the body of the positioning unit. The axial current of air likewise ensures that the end of the thread can be guided reliably and rapidly through the whole spinning nozzle.

BRIEF DESCRIPTION OF THE DRAWINGS

FIGS. 3*a–d* are various views, top, bottom, rear and side cross-sectional views, of the nozzle component of the FIG. 1 apparatus; and FIG. 4 is a schematic top view showing the positioning of the nozzle component of the FIG. 1, 2 apparatus against a complementary housing portion when the apparatus is in the thread guide/alignment position of FIG. 2.

DETAILED DESCRIPTION OF EXEMPLARY EMBODIMENTS

Figure 1:
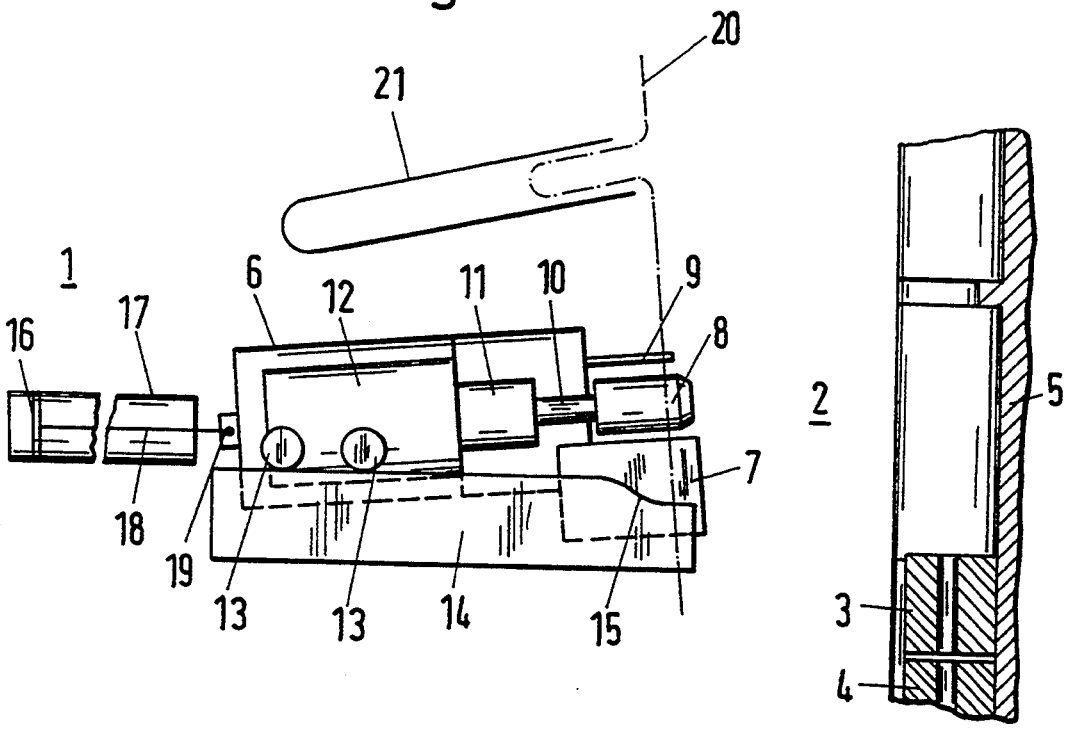
FIG. 1 is a schematic side partial cross-sectional view of an apparatus according to the invention, showing the apparatus in a first thread-receiving position preparatory to positioning a thread end at the outlet end of a yarn-spinning passage.

There is shown in FIG. 1 a thread end-receiving and positioning apparatus 1 and a yarn-spinning nozzle apparatus 2 which comprises an injector nozzle 3 and a twist nozzle 4. A partly represented housing 5 surrounds the spinning nozzle 2 and extends upwardly above and around the outlet end 40 of the nozzle component 3. Air suction conduits for cleaning purposes are typically provided in the housing 5 and are not shown. The positioning apparatus 1 together with a cooperating thread storage device 21 is typically provided on a robot which travels the length of a spinning machine for servicing any one of a plurality of side-by-side spinning stations. The apparatus 1 comprises a housing 6 on which an air-blowing nozzle 7 is mounted beneath a pair of transport rollers 8. One of the transport rollers 8 is typically connected to and driven by a driving motor 12 via a drive shaft 10 and coupling 11. The other of the transport rollers 8 is typically mounted so as to be resiliently spring-biased against the driven roller and controllably disengageable therefrom at selected points in time during the thread-receiving, guiding and thread-joining operations. In a typical operation, the end of a thread 20 is removed from a wind-up spool (not shown) by a controllably movable robot suction tube (not shown) and routed by the movable suction tube through the nip of rollers 8 and a recess 22 provided in the reverse blowing nozzle 7 described in detail below. During the course of this reverse threading of apparatus 1, the apparatus 1 is in the position shown in FIG. 1 spaced away from the spinning apparatus 2. Further, during the course of the thread routing process a selected excess length of thread is typically taken up and stored within a robot storage tube 21, e.g., by controlled unwinding of thread from the wind-up spool. The thread is routed through the recess 22 along the undersurface of the nozzle 7 and past the lower edge of a blade 34 where the thread is cut, thus establishing a precise length of thread relative to the nip of rollers 8 for use in precision overlapping of the thread end with a new sliver later on in a piecing or thread-joining process.

A thread guide 9, represented schematically, is mounted above the transport rollers 8. The entire housing 6 is movable longitudinally on guide rollers 13 which in turn ride on a rail element 14. The rail element 14 is typically mounted on the frame of the servicing robot (not shown). As shown in the FIGS. 1, 2 embodiment the rail element 14 is provided with a downwardly sloped step 15 described more fully with regard to FIG. 2. A piston 16 is provided in a cylinder 17 which controllably moves the housing to and fro via a connecting rod 18. The rod 18 is connected via a swivel connection 19 with housing 6. As can be readily imagined, an alternative mechanism for driving housing 6 along rail 14 can be provided. As described above, the end of the thread 20 is removed from a winding unit with a suction nozzle and guided by means of the thread guide 9, typically provided with a hook, between the transport rollers 8 and brought to the inlet of the air-blowing nozzle 7. The winding unit is typically controllably unwound with a friction roller (not shown), whereby a selected length of excess thread is stored in the storage tube 21. As soon as the end of the thread is guided between the transport rollers 8, which are initially disengaged, the rollers 8 are brought together and clamp the thread. The housing 6 is then moved from the position shown in FIG. 1 to the position shown in FIG. 2. As the apparatus 1 moves from the thread-receiving position FIG. 1 into the position of alignment, FIG. 2, the housing 6 is initially disposed at a slightly inclined angle relative to the rail element 14 such that the air-blowing jet 7 and the transport rollers 8 are disposed slightly above the outlet end of the spinning nozzle 3 when the forward roller 13 is at the upper edge of inclined surface 15. Continued movement of the housing 6 toward the housing 5 causes the forward roller 13 to travel downwardly above the inclined guide surface 15 which, in turn, causes housing 6 to pivot clockwise around the axis of rearward roller 13 whereby the undersurface of the air-blowing nozzle 7 is placed flat on the outlet end 40 of spinning jet 3 such that a perfect seal between the surfaces is achieved through the dead weight of apparatus 1. As can be readily imagined, the guide plate 15 can be alternatively configured such that the front guide roller 13 is continuously guided by the rail element 14 up to the point of positioning of apparatus 1 on nozzle 3.

Figure 2:
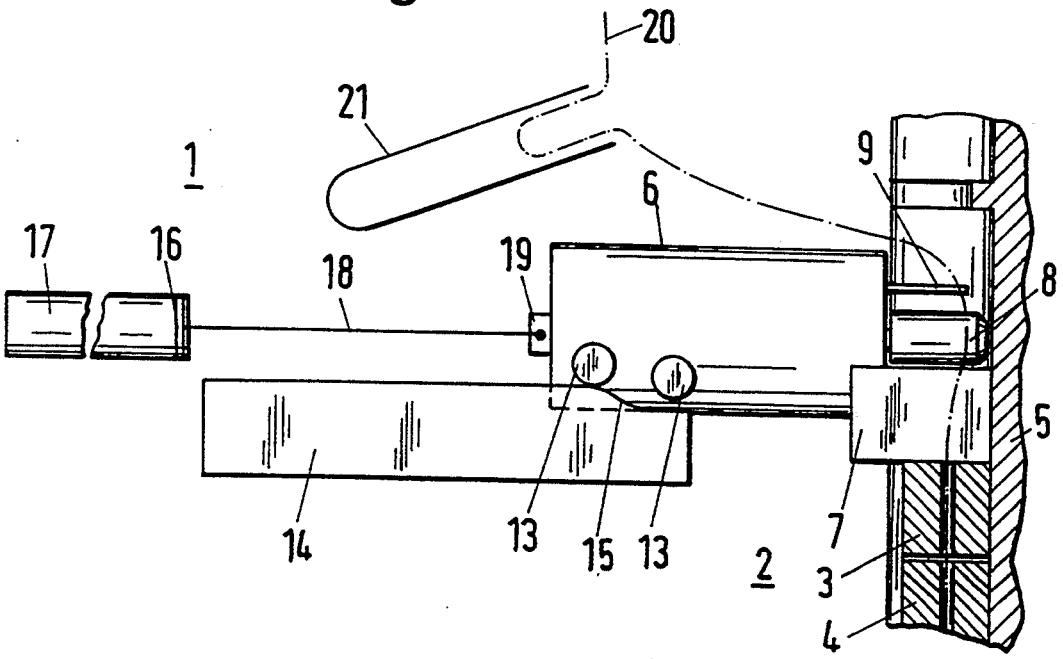
FIG. 2 is a side schematic view of the FIG. 1 apparatus, showing the apparatus after it has been moved into a second thread-guiding position in alignment with the yarn spinning passage of the spinning apparatus of a spinning machine.

As shown in FIG. 2, the housing 6 is fully moved into a position of alignment with the axis 41 of the central yarn passage of the spinning apparatus 3, 4. As described above, the yarn end 20 is previously routed through the yarn guide 9, between transport rollers 8 and through the reverse air-blowing nozzle 7, thus readying the apparatus for reversely blowing the thread 20 through the yarn passage of spinning apparatus 3, 4.

As best shown in FIG. 3*a* (top view) and 3*b* (bottom view), the air-blowing nozzle 7 is provided with a slot or a slot-shaped recess 22 extending from forward outer radial surface 33 inwardly to a central cylindrical aperture having a circular wall 25. The central cylindrical aperture is connected from above to a labyrinth-shaped air conduit 23. Holes are typically formed vertically to each other in the body of the air-blowing nozzle 7 during the manufacture of the nozzle 7 and are closed by pins 24*a*, 24*b*, such that a continuous labyrinth conduit 23 is formed which discharges at its terminal end into the top of the central cylindrical aperture which is formed by the circular cylindrically shaped wall 25. The terminal end of the pressure air conduit 23 is connected to the central cylindrical aperture via an intermediate small diameter air-blowing opening 26. The air-blowing opening 26 and the circular cylindrically shaped wall 25 are formed so as to have a common axis 27. When the housing 6 is in the aligned position of FIG. 2, the axis 27 of the central aperture and opening 26 are aligned coaxially with the axis 41 of the central yarn passage of the spinning apparatus 3, 4. A funnel-shaped inlet 28, FIGS. 3*a* and 3*d*, is provided in the recess 22 laterally to the air-blowing opening 26, the axis of the funnel 28 forming an acute angle 30 with the spinning axis 27, 41. Angle 30 typically lies in the range from about 15° to about 45°, most preferably about 30°.

The conduit 23 is connected at its inlet end to a source of pressurized air which blows a high stream jet of air successively through opening 26 and the aperture formed by circular cylindrical wall 25. The jet stream of air running downwardly along axis 27 creates a suction effect which draws air inwardly through recess 22. This suction effect assists in maintaining the thread 20 within the central cylindrical aperture of the nozzle 7. The funnel-shaped inlet 28 in particular acts to provide a convenient location for the thread 20 to initially be routed into the recess 22 during the thread-receiving operation when the movable robot suction tube routes the thread into the recess 22.

A large recess 31 is typically provided on the undersurface of the nozzle 7 in the region around slot 22. The relatively large recess 31 is connected to a less deep and narrower groove 32 which extends to the rear edge of the nozzle body 7. As shown in the embodiment of FIGS. 3*a* and 3*b*, the forward outer surface 33 of the nozzle 7 around the slot 22 is cylindrical in shape. Surface 33 can be formed into any selected configuration, and typically as a regular n-sided figure (e.g., a hexagonal figure). In the example represented, the surface 33 has the shape of a circular cylinder. The recess 31 and the groove 32 create an air cushion between the air-blowing nozzle 7 and the spinning apparatus 2 on which the air-blowing nozzle 7 is mounted in the alignment position. Further, the groove 32 is formed to be so small that only a small amount of the pressurized air routed through opening 26 and the central aperture 25 can escape through groove 32, the vast majority of pressurized air being routed into the central yarn passage of spinning apparatus 2 along its axis 41. At the end of the groove 32, a blade 34 or sharp edge is rigidly mounted on the nozzle body 7 for purposes of severing the end of the thread.

An exemplary exact functional sequence of the thread-guiding through spinning apparatus 2 is as follows. The end of the thread, as described above, is threaded between the transport rollers 8 and into the recess 22, whereby the end of the thread is guided into aperture 25 and along the length of the groove 32 and eventually severed by means of the blade 34 or the sharp edge. The whole housing 6 is moved into the positioning location, FIG. 2. Then, the pressure air for the air-blowing nozzle is switched on such that the end of the cut thread 20 is reversely blown into the outlet end of the yarn passage of nozzle 2. The transport rollers 8 are then typically controllably turned backwardly by means of the driving motor 12, such that the end of the thread 20 is fed backwardly and guided entirely through the spinning nozzle 2 by the axial stream of air emanating from nozzle 7, the rollers 8 controlling the precise length of thread 20 being reversely blown through the yarn passage. The end of the thread 20 is typically then grasped upon emerging from the other end, the inlet end (not shown), of the spinning nozzle 2, in a manner for example, as described in the Swiss Patent Application 04 550/89, and the pressure air of the air-blowing nozzle 7 is switched off. The transport rollers 8 are then disengaged and the positioning body 1 is returned to the first thread-receiving position.

As shown in FIGS. 1, 2, the spinning apparatus 2 is mounted on and surrounded by a housing 5. The housing 5 extends above and around the upper outlet end 40 of the spinning apparatus 3, 4. As shown in the specific embodiment of FIGS. 1, 2, 4, the inside surface 42 of the portion of housing 5 extending above spinning element 3 is configured to be complementary in shape to the shape of forward nozzle surface 33, e.g., circularly cylindrical, such that when the housing 6 is moved into the position of FIG. 2, forward surface 33 engages and seats against the complementary surface 42. The surface 42 thus supplements the positioning function of components 14, 15, 16, 17, 18 and acts as a positioning surface for nozzle 7, ensuring a positive alignment of axis 27 with axis 41.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. Apparatus for reverse threading a yarn through a yarn-spinning device having a central yarn passage having an outlet end and a longitudinal axis, the apparatus comprising a nozzle for receiving a thread end, aligning with the yarn passage and reversely blowing the thread end through the yarn passage, the nozzle including a longitudinal recess having an open end for receiving the thread end and a longitudinal cylindrical aperture communicating with the recess, the thread end being receivable through the open end of the recess into the cylindrical aperture, the cylindrical aperture having an axis, the apparatus further comprising a mechanism for moving the nozzle from a first yarn-receiving position to a second yarn-delivering position at the outlet end of the central yarn passage, the nozzle including an air conduit discharging air into the longitudinal aperture along the axis of the aperture and a bottom surface having a groove therein extending along the bottom surface for receiving the yarn end, the bottom surface of the nozzle mating with the outlet end of the yarn passage and the axis of the aperture being coaxially aligned with the yarn passage axis when the nozzle is in the yarn delivering position, the yarn end received within the groove on the bottom surface of the nozzle being maintained within the groove between opposing sidewalls of the groove and reversely blown through the yarn passage by air discharging through the aperture.

2. Apparatus of claim 1 wherein the nozzle has a forward outer surface portion having a contour selected to engageably mate against a complementary surface of a housing disposed upstream of the outlet end of the yarn passage upon movement of the nozzle into the second position, the axis of the cylindrical aperture being firmly coaxially aligned with the axis of the yarn passage upon mating of the forward nozzle surface with the housing surface.

3. Apparatus of claim 1 wherein the cylindrical aperture has a top end enclosed within the nozzle and a bottom end opening out of the nozzle, the enclosed top end connected to the air pressure conduit within the nozzle such that pressurized air discharging from the conduit is routed in a direction from the top end toward the open bottom end along the axis of the cylindrical aperture.

4. Apparatus of claim 3 wherein the inlet bore has a funnel shape having a larger open end open to the atmosphere and smaller end opening into the cylindrical aperture.

5. Apparatus of claim 1 wherein the recess includes an inlet bore having an axis intersecting the axis of the cylindrical aperture at an acute angle to the direction at which the pressurized air is routed along the axis of the cylindrical aperture.

6. Apparatus of claim 1 wherein the groove in the bottom surface of the nozzle extends laterally relative to the axis of the aperture along the bottom surface of the nozzle for laterally receiving the thread end.

7. Apparatus of claim 1 wherein the mechanism for moving comprises support rollers on which the apparatus is mounted and a guide rail on which the rollers rollably travel, the apparatus being movable between the first position and the second position by rollable travel of the support rollers on the guide rail.

8. Apparatus of claim 7 further comprising a fluid-powered piston connected to the apparatus for moving the apparatus such that the support rollers travel along the guide rail between the first and second positions.

9. Apparatus of claim 7 wherein the apparatus is mounted on at least two pair of support rollers such that the apparatus pivots around at least one pair of the support rollers in the course of travel between the first and second positions.

10. Apparatus of claim 7 wherein the nozzle has a forward outer surface portion having a contour selected to engageably mate against a complementary surface of a housing disposed upstream of the outlet end of the yarn passage upon movement of the nozzle into the second position, the axis of the cylindrical aperture being firmly aligned with the axis of the yarn passage upon mating of the forward nozzle surface with the housing surface.

11. Apparatus of claim 1 wherein the nozzle has a forward outer surface portion having a contour selected to engageably mate against a complementary surface of a housing disposed upstream of the outlet end of the yarn passage upon movement of the nozzle into the second position, the axis of the cylindrical aperture being firmly aligned with the axis of the yarn passage upon mating of the forward nozzle surface with the housing surface.

12. Apparatus of claim 1 wherein the mechanism for moving comprises support rollers on which the apparatus is mounted and a guide rail on which the rollers rollably travel, the apparatus being movable between the first position and the second position by rollable travel of the support rollers on the guide rail.

13. Apparatus of claim 1 wherein the apparatus is mounted on at least two pair of support rollers such that the apparatus pivots around at least one pair of the support rollers in the course of travel between the first and second positions.

14. Apparatus of claim 1 wherein the apparatus pivots into the second position upon movement from the first position to the second position.

15. Apparatus of claim 1 wherein the apparatus pivots into the second position upon movement from the first position to the second position.

16. Apparatus of claim 15 wherein the apparatus pivots upon movement from the first position to the second position under a torque force created by the weight of the apparatus.

17. Apparatus for reverse threading a yarn through a yarn-spinning device having a central yarn passage having an outlet end and a longitudinal axis, the apparatus comprising a nozzle for receiving a thread end, aligning with the yarn passage, and reversely blowing the thread end through the yarn passage, the nozzle including a longitudinal recess having an open end for receiving the thread end and a longitudinal cylindrical aperture communicating with the recess, the thread end being receivable through the open end of the recess into the cylindrical aperture, the cylindrical aperture having an axis, the apparatus further comprising a mechanism for moving the nozzle from a first yarn-receiving position to a second yarn-delivering position at the outlet end of the central yarn passage, the axis of the cylindrical aperture being aligned with the axis of the yarn passage when the nozzle is in the second position, the nozzle further comprising an air conduit connected at one end to a source of pressurized air and discharging at another end into the recess such that air is blown through the recess and reversely through the central yarn passage when the nozzle is in the second position, wherein the mechanism for moving comprises support rollers on which the apparatus is mounted and a guide rail on which the rollers rollably travel, the apparatus being movable between the first position and the second position by rollable travel of the support rollers on the guide rail, wherein the apparatus is mounted on at least two pair of support rollers such that the apparatus pivots around at least one pair of the support rollers in the course of travel between the first and second positions, wherein the guide rail is stepped, having an inclined portion, at least one pair of the support rollers travelling above the inclined portion of the guide rail during movement of the apparatus from the first position to the second position, the apparatus pivoting into the second position upon travel of at least one pair of support rollers above the inclined portion of the guide rail.

18. Apparatus for reverse threading a yarn through a yarn-spinning device having a central yarn passage having an outlet end and a longitudinal axis, the apparatus comprising a nozzle for receiving a thread end, aligning with the yarn passage, and reversely blowing the thread end through the yarn passage, the nozzle including a longitudinal recess having an open end for receiving the thread end and a longitudinal cylindrical aperture communicating with the recess, the thread end being receivable through the open end of the recess into the cylindrical aperture, the cylindrical aperture having an axis, the apparatus further comprising a mechanism for moving the nozzle from a first yarn-receiving position to a second yarn-delivering position at the outlet end of the central yarn passage, the axis of the cylindrical aperture being aligned with the axis of the yarn passage when the nozzle is in the second position, the nozzle further comprising an air conduit connected at one end to a source of pressurized air and discharging at another end into the recess such that air is blown through the recess and reversely through the central yarn passage when the nozzle is in the second position, wherein the conduit discharges into the recess such that the pressurized air is routed through the recess in a direction along the axis of the cylindrical aperture, wherein the axis of the cylindrical aperture is aligned with the axis of the yarn passage upon movement of the apparatus into the second position, wherein the mechanism for moving comprises support rollers on which the apparatus is mounted and a guide rail on which the rollers rollably travel, the apparatus being movable between the first position and the second position by rollable travel of the support rollers on the guide rail, wherein the apparatus is mounted on at least two pair of support rollers such that the apparatus pivots around at least one pair of the support rollers in the course of travel between the first and second positions, wherein the guide rail is stepped, having an inclined portion, at least one pair of the support rollers travelling above the inclined portion of the guide rail during movement of the apparatus from the first position to the second position, the apparatus pivoting into the second position upon travel of at least one pair of support rollers above the inclined portion of the guide rail.

19. Apparatus for reverse threading a yarn through a yarn spinning device having a yarn passage with an outlet end and an axis, the apparatus comprising a nozzle for receiving a thread end and reversely blowing the thread end through the yarn passage and means for moving the nozzle from a first yarn receiving position to a second yarn delivering position, the nozzle including a yarn delivery aperture having an axis extending longitudinally through the nozzle for receiving the thread end, and an air conduit discharging pressurized air into the delivery aperture along the longitudinal axis, the nozzle further including a bottom surface for mating with the outlet end of the yarn passage, the bottom surface having a groove therein communicating with the aperture for receiving the thread end, the groove having sidewalls for maintaining the received thread end in the groove in a position for being reversely blown through after mating of the bottom surface with the outlet end, the pressurized air discharging through the aperture and delivering the thread end received in the aperture and the groove reversely through the yarn passage when the nozzle is in the second yarn delivery position.

20. The apparatus of claim 19 wherein the bottom surface of the nozzle mates with the outlet end of the yarn passage and the axis of the aperture is coaxially aligned with the axis of the yarn passage when the nozzle is in the yarn delivering position.

21. The apparatus of claim 20 wherein the groove extends laterally along the bottom surface of the nozzle relative to the longitudinal axis of the aperture, the yarn end being received within the laterally extending groove and reversely blown through the yarn passage after the nozzle is moved into the yarn delivering position.

22. The apparatus of claim 19 wherein the groove extends laterally along the bottom surface of the nozzle relative to the longitudinal axis of the aperture, the yarn end being received within the laterally extending groove and reversely blown through the yarn passage after the nozzle is moved into the yarn delivering position.

23. The apparatus of claim 19 wherein the bottom surface of the nozzle mates with the outlet end of the yarn passage in the second position, the groove extending laterally along the bottom surface of the nozzle relative to the longitudinal axis of the aperture with the yarn end being received within the laterally extending groove upon mating of the bottom surface of the nozzle with the outlet end of the yarn passage.

24. Apparatus for reverse threading a yarn through a yarn spinning device having a central yarn passage having an outlet end and an axis, the apparatus comprising a nozzle for receiving a thread end and reversely blowing the thread end through the yarn passage, the nozzle comprising:

a nozzle housing having an aperture extending longitudinally through the nozzle housing along a yarn delivery axis and a yarn receiving slot extending through an outside surface of the nozzle housing and communicating with the aperture, the slot receiving and guiding the yarn into longitudinal aperture;

the nozzle further comprising an air conduit connected at one end to a source of pressurized air and discharging at another end into the longitudinal aperture such that air is blown along the yarn delivery axis through the aperture;

the nozzle being movable from a first yarn receiving position to a second yarn delivering position at the outlet end of the yarn passage;

wherein the nozzle has a bottom surface for mating with the outlet end of the yarn passage, the bottom surface of the nozzle having a groove including sidewalls for receiving the thread end, the thread end which is received within the groove being reversely blown through the yarn passage after the bottom surface mates with the outlet end of the yarn passage.

25. The apparatus of claim 24 wherein the nozzle has a bottom surface for mating with the outlet end of the yarn passage, the bottom surface of the nozzle having a groove therein for receiving the thread end, the thread end which is received within the groove being reversely blown through the yarn passage after the bottom surface mates with the outlet end of the yarn passage.

* * * * *